United States Patent [19]

Cohrs

[11] Patent Number: 4,741,563

[45] Date of Patent: May 3, 1988

[54] CENTER CASE ASSEMBLY, AND A UNIVERSAL, CENTER CASE SUB-ASSEMBLY

[75] Inventor: Richard B. Cohrs, Indianapolis, Ind.

[73] Assignee: Von Duprin, Inc., Indianapolis, Ind.

[21] Appl. No.: 849,018

[22] Filed: Apr. 7, 1986

[51] Int. Cl.[4] ..... E05B 65/10

[52] U.S. Cl. ..... 292/21; 292/7; 292/93; 292/168

[58] Field of Search ..... 292/7, 21, 92, 93, 36, 292/168, 172, 221

[56] References Cited

U.S. PATENT DOCUMENTS

| | | | |
|---|---|---|---|
| 1,094,677 | 4/1914 | Page | 292/21 |
| 2,320,298 | 5/1943 | Phillips | 292/92 |
| 2,426,041 | 8/1947 | Moorhouse | 292/93 |
| 2,785,914 | 3/1957 | Thomas et al. | 292/7 |
| 2,962,889 | 12/1960 | McConnell | 292/92 |
| 3,097,007 | 7/1963 | Eichacker et al. | 292/92 |
| 3,432,631 | 3/1969 | Deutscher et al. | 292/92 |
| 3,663,047 | 5/1972 | Zawadzki | 292/92 |
| 3,767,238 | 10/1973 | Zawadzki | 292/92 |
| 4,167,280 | 9/1979 | Godec et al. | 292/92 |
| 4,427,223 | 1/1984 | Godec et al. | 292/92 |
| 4,601,499 | 7/1986 | Kim | 292/36 |

FOREIGN PATENT DOCUMENTS

| | | | |
|---|---|---|---|
| 259762 | 6/1912 | Fed. Rep. of Germany | 292/92 |
| 546276 | 3/1932 | Fed. Rep. of Germany | 292/93 |
| 13249 | 6/1906 | United Kingdom | 292/92 |

*Primary Examiner*—Carl D. Friedman
*Assistant Examiner*—Michael Safavi
*Attorney, Agent, or Firm*—B. J. Murphy; W. C. Vliet

[57] ABSTRACT

Central to the invention is a universal, center case sub-assembly from which, by adding components thereto, one may fabricate a rim style center case assembly, or a concealed-vertical style center case assembly, or a surface-vertical style center case assembly, or a combination rim and vertical style center case assembly, for a panic-type exit device. Besides minimizing the number of diverse components and parts required for the fabrication of the aforesaid center case assembly styles, the universal sub-assembly comprises an improved design which offers a marked mechanical/leverage advantage to the trim linkage.

4 Claims, 8 Drawing Sheets

FIG. 6c
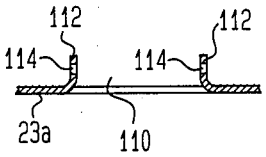
FIG. 6a
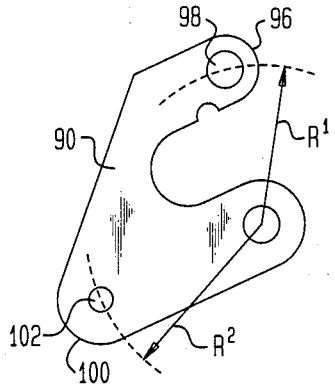
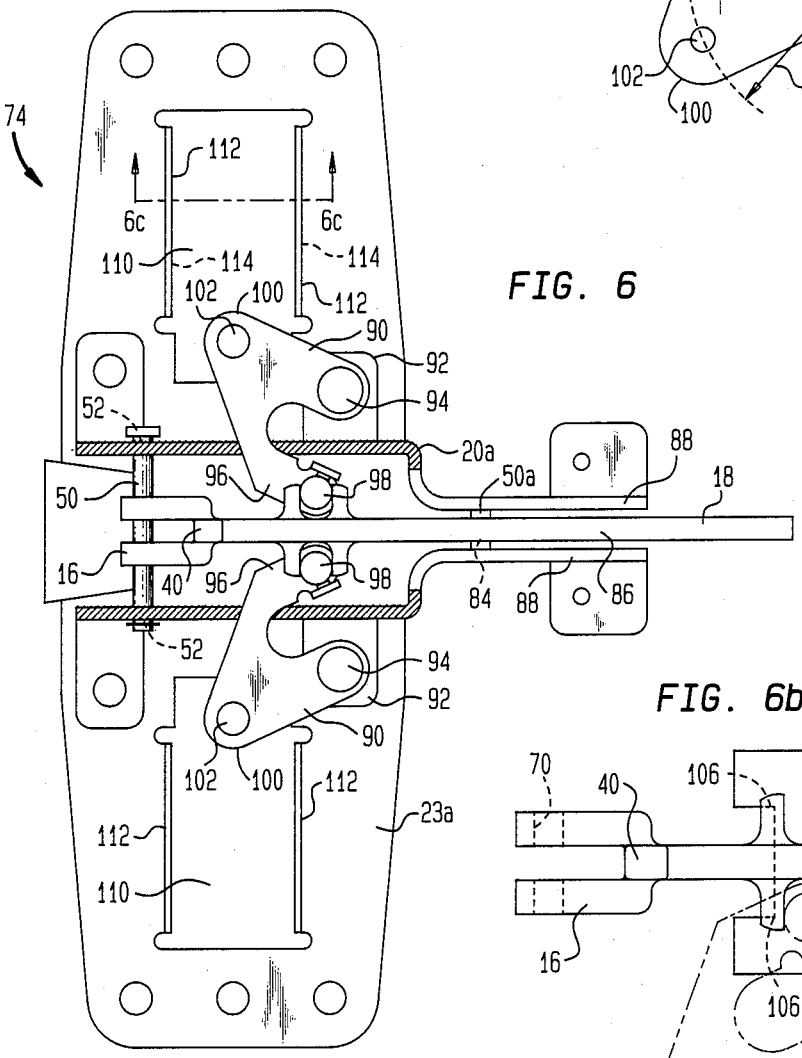
FIG. 6
FIG. 6b
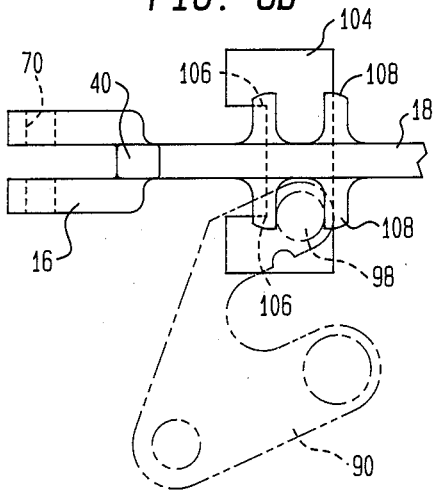

CENTER CASE ASSEMBLY, AND A UNIVERSAL, CENTER CASE SUB-ASSEMBLY

This invention pertains to center case assemblies for panic-type exit devices, and in particular to a novel, universal, center case sub-assembly usable in the fabrication of diverse-function center case assemblies.

Commonly, each center case assembly is constructed of those parts and components which pertain to the intended end function of the assembly. As there obtain diverse functions, there are fabricated diverse center case assemblies and, consequently, manufacturing and stocking facilities must contend with a need to make, and have in supply, a great number of discrete parts and components.

Heretofore, no one has adequately addressed the matter of standardizing as many parts and components, of the diverse-function center case assemblies, as will be possible to minimize the aforesaid number of parts and components requiring manufacture and stocking.

It is an object of this invention, then, to address the matter, and set forth a standardized, and therefore universal, center case sub-assembly usable in the construction of a plurality of diverse-function center case assemblies.

It is particularly an object of this invention to set forth a center case assembly for a rim style, panic-type, exit device, comprising first means defining a chassis; second means defining a center case housing; said housing being coupled to said chassis; a main control link; said housing and link having means cooperative for guiding said link for slidable translation thereof, within said housing, between first and second dispositions; means within said housing resiliently biasing said link in one of said dispositions; and a pair of bellcranks pivotably mounted to one of said first and second means; wherein each of said bellcranks has a first end engaged with said link (a) for pivotable movement thereof coincident with, and as a consequence of, translation of said link, and (b) for translation of said link coincident with, and as a consequence of, bellcrank pivotable movement; said chassis has means on opposite sides of said housing defining guideways for movable thumbpiece lifts; and further including movable thumbpiece lifts engaged with said guideways; wherein said bellcranks each have a second end which (a) is pivotably joined to one of said lifts, and (b) with bellcrank pivotable movement, slues through an arc, of a given radius, toward and away from that one of said guideways with which the lift, which is joined thereto, is engaged; said control link has (a) means at one end for attachment thereof to a control link translating mechanism of a panic-type exit device, and (b) latchbolting means coupled to the end thereof opposite said one end; and wherein said first end of each of said bellcranks, as a consequence of bellcrank pivotable movement, slues through an arc having a shorter radius than said given radius.

It is also an object of this invention to disclose a center case assembly, for a concealed vertical style, panic-type, exit device, comprising first means defining a chassis; second means defining a center case housing coupled to said chassis; a main control link; said housing and link having means cooperative for guiding said link for slidable translation thereof, within said housing, between first and second dispositions; and a pair of bellcranks pivotably mounted to one of said first and second means; wherein each of said bellcranks has a first end engaged with said link (a) for pivotable movement thereof coincident with, and as a consequence of, translation of said link, and (b) for translation of said link coincident with, and as a consequence of, bellcrank pivotable movement; said chassis has means on opposite sides of said housing defining guideways for movable thumbpiece lifts; and further including movable thumbpiece lifts engaged with said guideways; wherein said bellcranks each have a second end which (a) is pivotably joined to one of said lifts, and (b) with bellcrank pivotable movement, slues through an arc of a given radius, toward and away from that one of said guideways with which the lift, which is joined thereto, is engaged; said control link has means at one end for attachment thereof to a control link translating mechanism of a panic-type exit device; and wherein said first end of each of said bellcranks, as a consequence of bellcrank pivotable movement, slues through an arc having a shorter radius than said given radius.

It is another object of this invention to set forth a center case assembly for a surface vertical style, panic-type, exit device, comprising first means defining a chassis; second means defining a center case housing; said housing being coupled to said chassis; a main control link; said housing and link having means cooperative for guiding said link for slidable translation thereof, within said housing, between first and second dispositions; and a pair of bellcranks pivotably mounted to one of said first and second means; wherein each of said bellcranks has a first end engaged with said link (a) for pivotable movement thereof coincident with, and as a consequence of, translation of said link, and (b) for translation of said link coincident with, and as a consequence of, bellcrank pivotable movement; said chassis has means on opposite sides of said housing defining guideways for movable thumbpiece lifts; and further including movable thumbpiece lifts engaged with said guideways; wherein said bellcranks each have a second end which (a) is pivotably joined to one of said lifts, and (b) with bellcrank pivotable movement, slues through an arc, of a given radius, toward and away from that one of said guideways with which the lift, which is joined thereto, is engaged; said control link has means at one end for attachment thereof to a control link translating mechanism of a panic-type exit device; and wherein said first end of each of said bellcranks, as a consequence of bellcrank pivotable movement, slues through an arc having a shorter radius than said given radius.

A further object of this invention comprises disclosing a center case assembly, for a combination rim and vertical style, panic-type, exit device, comprising first means defining a chassis; second means defining a center case housing; said housing being coupled to said chassis; a main control link; said housing and link having means cooperative for guiding said link for slidable translation thereof, within said housing, between first and second dispositions; means within said housing resiliently biasing said link in one of said dispositions; and a pair of bellcranks pivotably mounted to one of said first and second means; wherein each of said bellcranks has a first end engaged with said link (a) for pivotable movement thereof coincident with, and as a consequence of, translation of said link, and (b) for translation of said link coincident with, and as a consequence of, bellcrank pivotable movement; said chassis has means on opposite sides of said housing defining guideways for movable thumbpiece lifts; and further including movable thumbpiece lifts engaged with said guideways; wherein said bellcranks each have a second end which (a) is pivotably joined to one of said lifts, and (b) with bellcrank pivotable movement, slues through an arc, of a given radius, toward and away from that one of said guideways with which the lift, which is joined thereto, is engaged; said control link has (a) means at one end for attachment thereof to a control link translating mechanism of a panic-type exit device, and (b) latchbolting means coupled to the end thereof opposite said one end; and said lifts each have means for coupling a vertical rod thereto.

A further and particularly significant object of this invention is to set forth a universal, center case sub-assembly, for a panic-type exit device, comprising first means defining a chassis; second means defining a center case housing coupled to said chassis; a main control link; said housing and link having means cooperative for guiding said link for slidable translation thereof within said housing between first and second dispositions; and a pair of bellcranks pivotably mounted to one of said first and second means; wherein each of said bellcranks has a first end engaged with said link (a) for pivotable movement thereof coincident with, and as a consequence of translation of said link, and (b) for translation of said link coincident with, and as a consequence of, bellcrank pivotable movement; said chassis has means on opposite sides of said housing defining guideways for movable thumbpiece lifts; said bellcranks each have a second end with means thereat for coupling thereof to a thumbpiece lift, and which, with bellcrank pivotable movement, slues through an arc, of a given radius, toward and away from that one of said guideways which is most proximate thereto; said control link has (a) means at one end for attachment thereof to a control link translating mechanism of a panic-type exit device, and (b) means at the opposite end thereof for coupling thereto a latchbolt link; and said housing has said means for pinning a latchbolt, pivotably, thereto.

Further objects of this invention, as well as the novel features thereof, will become more apparent by reference to the following description taken in conjunction with the accompanying figures in which:

FIG. 6 is a view, similar to that of FIG. 1, of the novel, universal, center case sub-assembly according to the best mode contemplated by the inventor for carrying out the invention;

Figure 7:
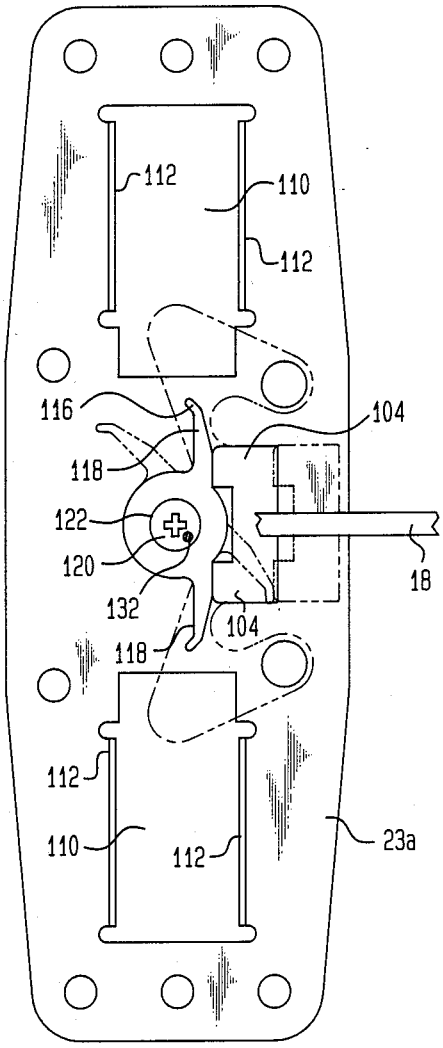
Figure 8:
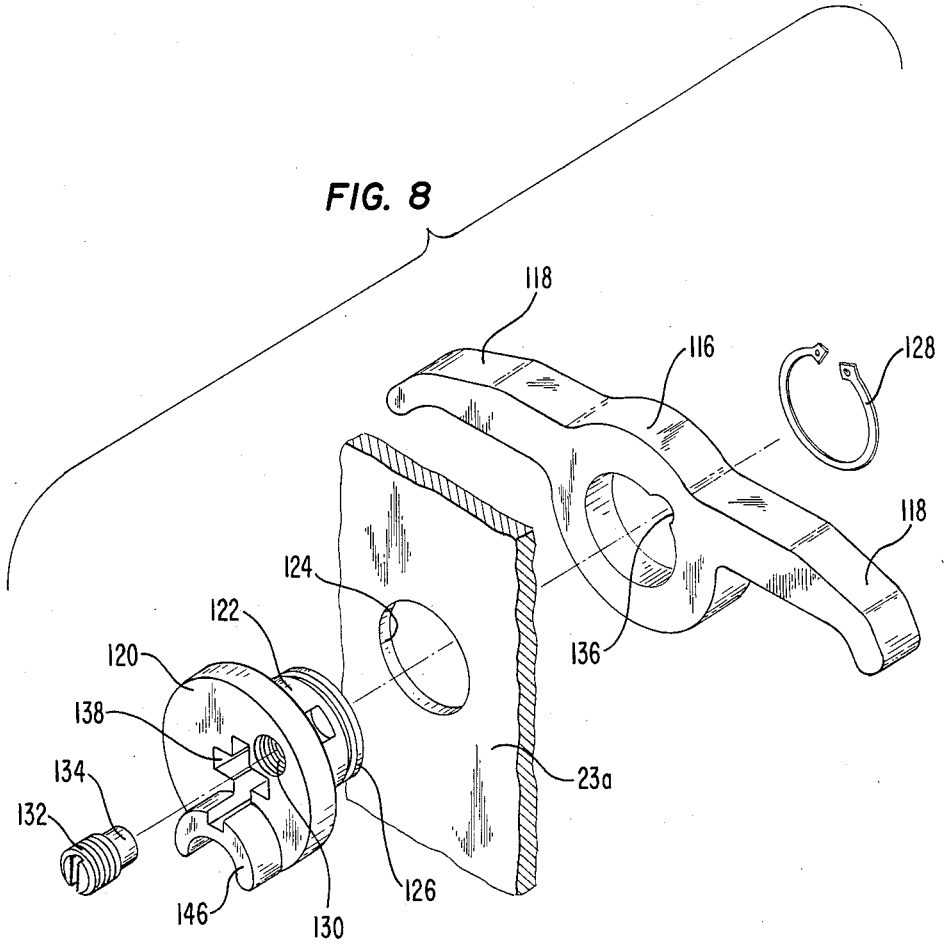
Figure 9:
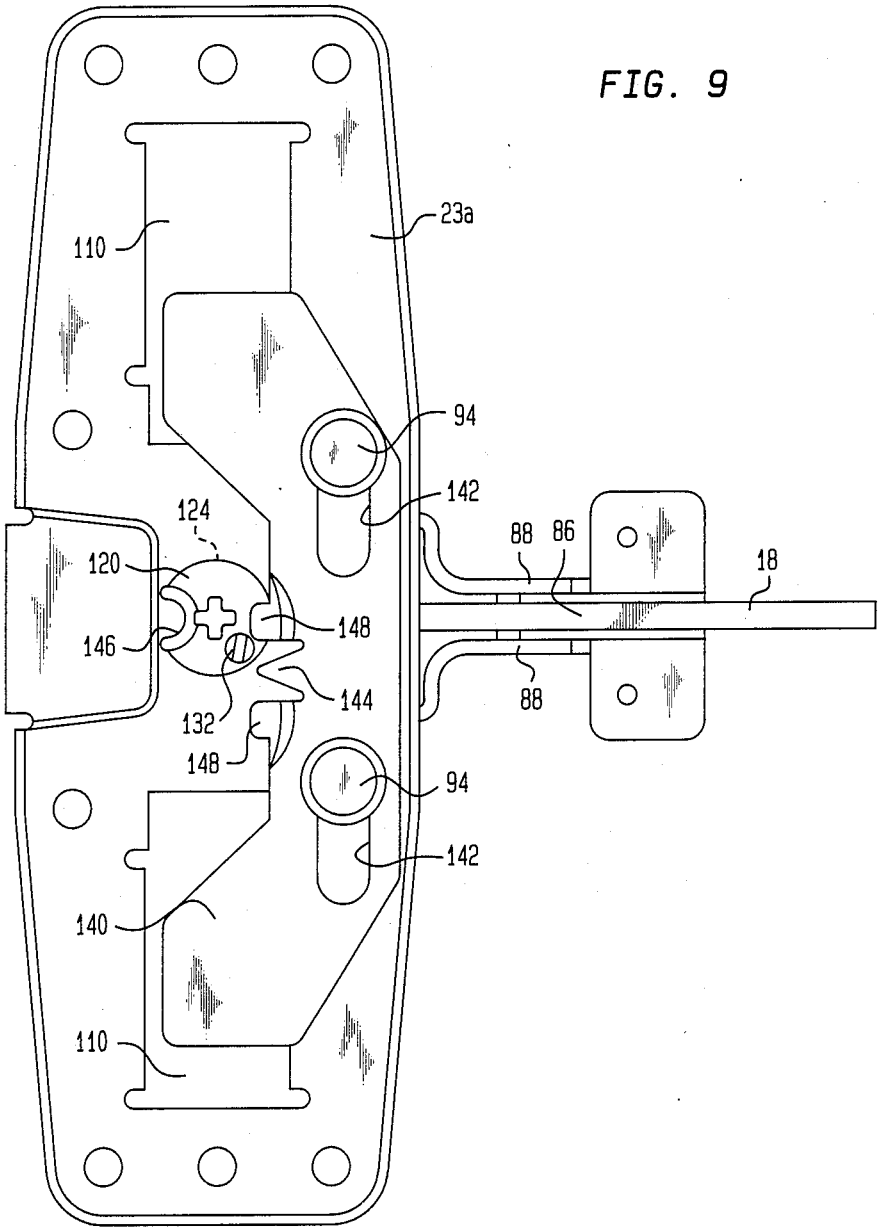
Figure 11:
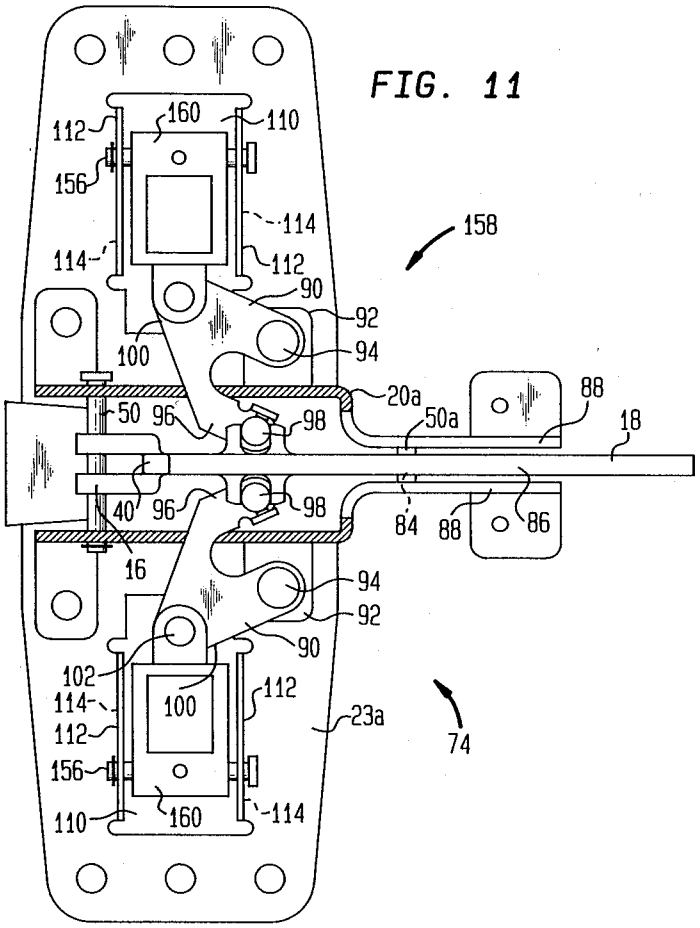
Figure 10:
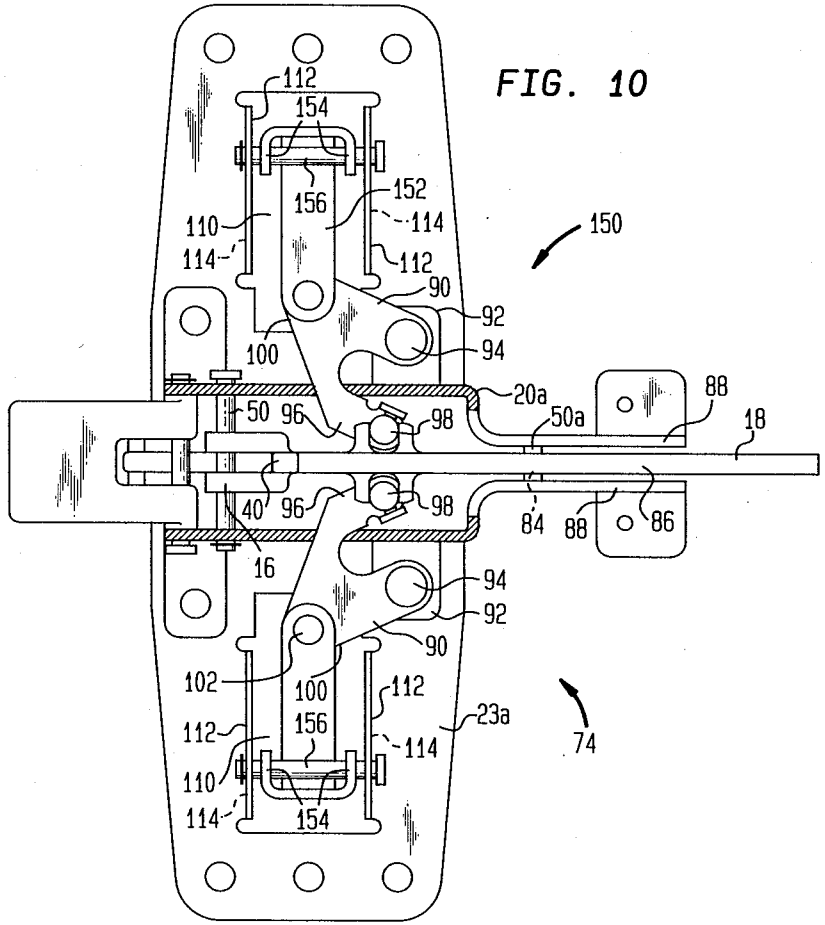
Figure 12:
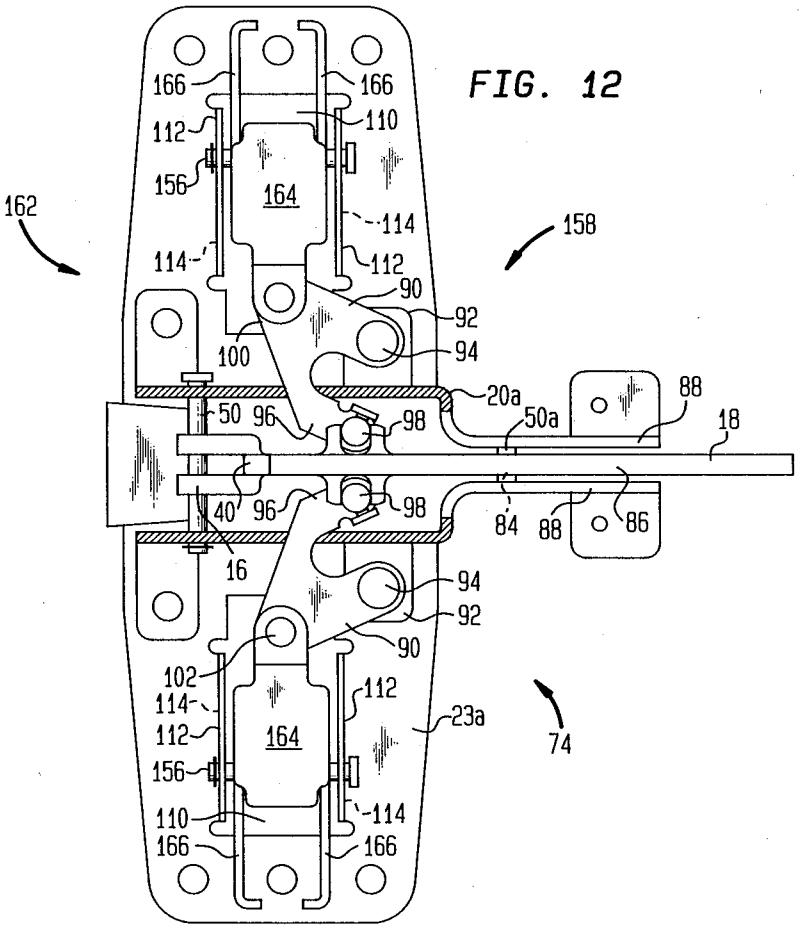

FIGS. 6*a* and 6*b* are detail illustrations of the main control link and the associated bellcranks;

FIG. 6*c* is a cross-sectional view taken along section 6*c*—6*c* in FIG. 6;

FIG. 7 is an illustration similar to that of FIG. 6 with several components omitted, however, to show the night latch cam;

FIG. 8 is an exploded view depicting the night latch cam, dowel, and drive screw relationship;

FIG. 9 is an illustration of the underside of the chassis showing the cooperative relationship between the dowel, drive screw, and the trim tumbler; and FIGS. 10, 11 and 12 are illustrations similar to FIG. 6 of a rim-style, a concealed-vertical-style, and a surface-vertical-style center case assembly, respectively.

Figure 1:
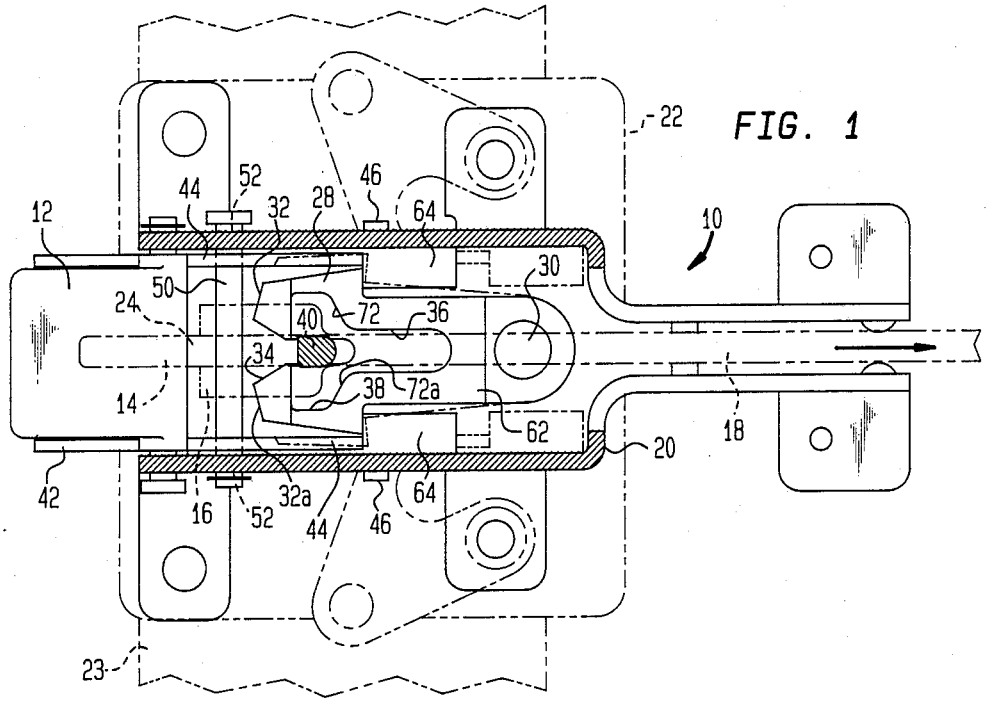
FIG. 1 is a plan view of an embodiment of a prior art latching assembly in which, however, the chassis and cover are shown only in phantom, and the housing is cross-sectioned (the top portion thereof having been removed for clarity)
Figure 3:
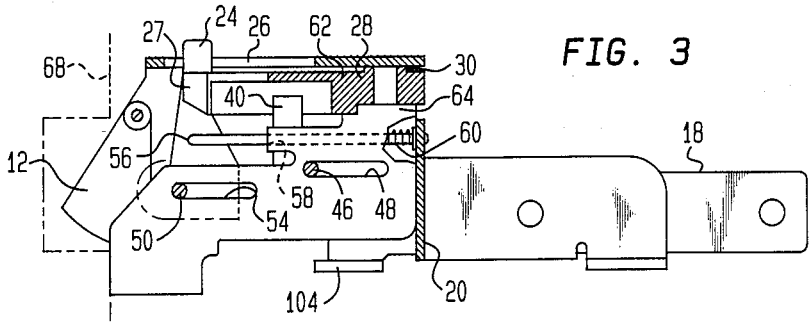
FIG. 3 is a side, elevational view, with the housing partially cross-sectioned, of the prior art latching assembly of FIG. 1, albeit with the novel main control link incorporated therein.

As shown in the figures, a latching assembly 10 having a latch 12 coupled, by means of a link 14, to a clevis 16 of a main control link 18, is shown mounted within a frame or center case housing 20 for reciprocating or axial movement therewithin. The frame or housing 20 receives a cover 22, and the housing 20 is fastened to a chassis 23, the cover and chassis being shown only in phantom, and only a portion of the chassis is depicted. According to practices well-known in the prior art, the main control link 18 is operated (by a link translating mechanism of a panic-type exit device, or the like) to translate the clevis 16 and the link 14, lengthwise or axially of the housing 20, to retract and extend the latch 12. The latch 12 has an upstanding limb 24 which traverses a guide slot 26 provided therefor in the top of the housing 20. When the latch 12 is in its fully extended position, as shown in FIGS. 1 and 3, it just clears the forward termination 27 of a gravity dog 28. The gravity dog 28 is an elongate, bifurcated element pivoted at one end, by means of a pin 30, to the center-case housing 20. As could be expected, the gravity dog 28 is free to pivot, in response to gravity, to a "down" position as would occur in the FIG. 1 disposition of the latching assembly, if it is not obstructed in such movement. (The assembly 10 can be used on a left-hand door, or a right-hand door, and the gravity dog 28 will pivot "down" accordingly, in either handed application.) Now, if the dog 28 pivots, it disposes one of the bifurcation ends 32 or 32*a* obstructively before the limb 24. As shown in FIG. 1, end 32 will come into obstruction of the limb 24 (as "down" is at the lower portion of the Figure).

A plurality of structures cooperate to either (a) restrain the gravity dog 28 from pivoting to a "down" position, or (b) to allow it to fall to such "down" position.

First, as noted, the dog 28 is bifurcated, and has an entry slot 34, with a widened mouth, formed into the termination 27 which is opposite the pivot pin 30. This slot 34 slidably receives the limb 24, upon the control link 18 being retracted (in the direction of the arrow in FIG. 1). Next, the gravity dog 28 has a shallow recess formed in the underside thereof, the recess having a narrow portion 36 and an adjoining wide portion 38. The main control link 18 also has an upstanding limb 40 which, upon the latching assembly 10 being retracted, enters the narrow portion 36 of the gravity dog recess. In the aforesaid circumstances, i.e., with the control link 18 retracted, the gravity dog 28 cannot pivot to a "down" position. Rather, it is constrained to maintain an alignment with the axis of the housing 20; limbs 24 and 40 will have entered the slot 34 and the recess narrow portion 36, respectively.

The assembly 10 has an auxiliary latch bolt 42. It comprises a pair of elongate, parallel limbs 44 which reach into the center-case housing 20 and are supported slidably therein, by means of two rivets 46 which penetrate the wall of the housing 20 and slots 48 formed in the limbs 44; also, a same linkage pin 50 which couples the latch link 14 to the clevis 16, is passed through a pair of parallel slots 52 in the sides of the housing 20, and through another pair of forward slots 54 formed in the limbs 44. A pair of guide rods 56, fixed to the rear of the housing 20, are passed through tabs 58 formed in the auxiliary latch bolt 42, and compression springs 60, mounted about the rods 56, and confined between the rear of the centercase housing 20 and the tabs 58, constantly urge the auxiliary latch bolt 42 to a forward (i.e., opposite to the FIG. 1 arrow direction) position.

The gravity dog 28 has a narrow shank 62 and the auxiliary latch bolt 42 has a pair of inwardly-directed leaves 64 which, upon the auxiliary latch bolt retracting within the housing 20, traverse the shank 62. When the auxiliary latch bolt 42 is fully retracted (i.e., in the arrow direction) the leaves 64 are, as shown in dashed outline in FIG. 1, and in full-line illustration in FIG. 3, astride the pivot-pinned end of the dog 28. In such a positioning, of course, the leaves 64 are unable to restrain the dog 28 from pivoting to a "down" position. When the leaves 64, however, are forward, along the shank 62, they prevent the dog 28 from executing a pivotable movement out of axial alignment with the housing 20.

If the latch 12 is pushed in a retracting direction (the arrow direction), as by engagement with a strike, or pulled in that direction by the retraction of the control link 18, the auxiliary latch bolt 42 retracts therewith. This occurs because the latch bolt 42 bears against a pair of tabs 43 formed on the auxiliary latch bolt 42 to move it against the bias of the springs 60. If the latch 12 is returned to a projected positioning, the auxiliary latch bolt 42 also returns therewith; the springs 60, of course, effect this. However, if the latch 12 is returned to a projected positioning, and the auxiliary latch bolt 42 is held in a retracted positioning, the latch 12 becomes deadlocked.

FIG. 3 shows the device in engagement with a phantom (dashed-line) strike 68 and it will be seen that, while the latch 12 can enter the recess provided therefor, the auxiliary latch bolt 42 is held retracted by the surface of the strike. Therefore, the leaves 64 are astride the pivot-pinned end of the dog 28, and the latter can now respond to gravity and obstruct the retraction of the latch bolt limb 24. Accordingly, if one were to force a credit card, or a thin-bladed stiff tool between the latch 12 and the strike 68, it would be without effect; it is impossible for the latch 12 to be retracted in this manner. The bifurcation end 32 will be in blocking obstruction of the limb 24 and, although the dog 28 has dropped to its "down" position, the other limb 40, of the main control link 18, is within the wide portion 38 of the gravity dog recess. Because of the linkage between the main control link 18, the clevis 16, and the latch 12, the latch can be easily retracted simply by retracting the main control link 18. The clevis 16 which is coupled to the latch 12 has a bore 70 for the link pin 50. Thus, upon retraction of the main control link, latch 12 proceeds to retract. Upon retraction of the control link 18, however, the limb 40 thereof slidably impacts with the tapered surface 72 or 72*a*, of the recess in the dog 28, which joins the portions 36 and 38. Resultantly, the dog 28 is forced toward axial alignment thereof with the housing 20. Now, the limb 40 can enter the portion 36, and the limb 24 can enter the widened access of the slot 34. The end 32, therefore, has been slued out of obstruction of the limb 24, and the latch 12 can be fully retracted.

As noted, excepting the particular main control link 18 which proceeds from this invention (and notwithstanding its utility in the latching assembly 10), all the aforesaid pertains to prior art.

The instant invention comprises a universal, center case sub-assembly 74 for a panic-type exit device. The sub-assembly 74 is universal in that it comprises common parts usable in assembling any of the following: a rim-style, center case assembly (FIG. 10), a concealed-vertrcal-style, center case assembly (FIG. 11), a surface-vertical-style, center case assembly (FIG. 12) or a center case assembly for a combination rim- and vertical-style, for a panic-type, exit device.

Figure 4:
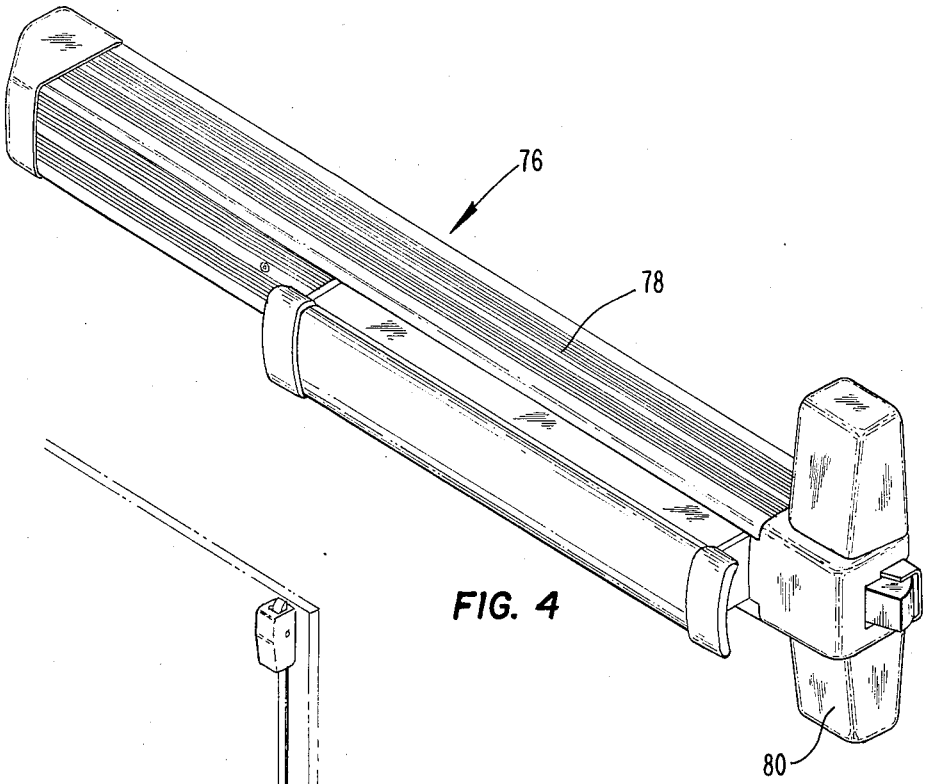
FIGS. 4 and 5 are perspective illustrations of a rim-style, panic-type, exit device, and a surface-vertical-style, panic-type, exit device, respectively.
Figure 5:
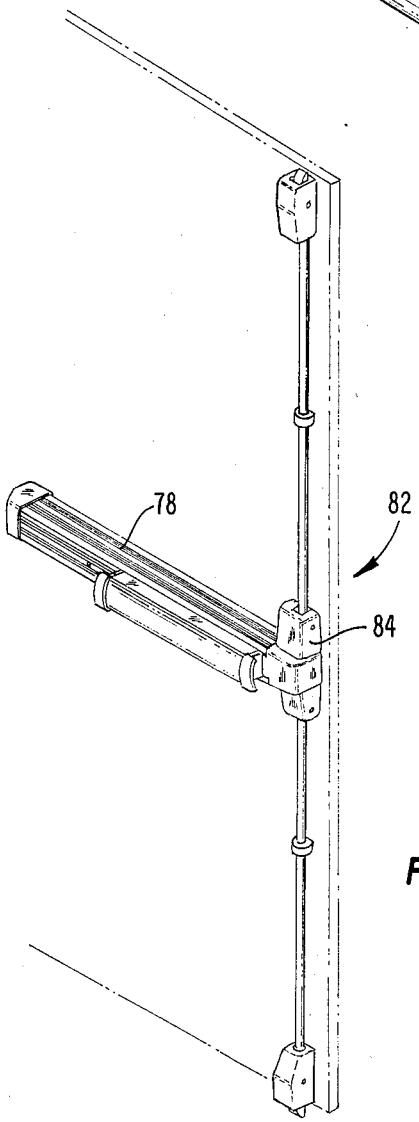

FIG. 4 is a perspective illustration of a rim-style, panic-type, exit device 76 comprising a mechanism case assembly 78 and a center case assembly 80. FIG. 5 is a perspective illustration of a vertical-style, panic-type, exit device 82, it too having a mechanism case assembly 78, and a center case assembly 84.

FIGS. 6, 6*a*, 6*b*, 6*c*, 7, 8 and 9 depict the structure of the universal, center case sub-assembly 74. It comprises a chassis 23*a* to which is fixed a center case housing 20*a*. The main control link 18 is slidably supported in the housing 20*a*; pin 50, in traverse of the clevis 16, is engaged, at ends thereof, in slots 52 formed in opposite sides of the housing 20*a*. Another pin 50*a* penetrates another slot 84 formed in the shank 86 of the main control link 18, and is fixed in the thereadjacent limbs 88 of the housing 20*a*. The top of the housing has been cut away to show some of the novel, confined structures. This universal, center case sub-assembly 74 incorporates a pair of bellcranks 90. Each is pivotably mounted onto a mounting lug 92 of the housing 20*a* by fasteners 94 which also fix the lugs 92 to the chassis 23*a*. Each bellcrank 90 has a first end 96, which carries thereupon a sphere 98, and which pivotably slues through an arc having a radius $R^1$. Another, second end 100 of each bellcrank 90, has an aperture 102 therein, and slues through an arc having a radius $R^2$. The aforesaid, former radius is shorter than the latter. Accordingly, upon the bellcranks being turned on the fasteners 94 from the second ends 100, the latter are mechanically advantaged over the first ends 96; it requires minimal force, then, to displace ends 96 by applying the force to ends 100. Compared to prior art designs, this bellcrank arrangement reduces the force required, by the trim linkage, to retract the main control link 18 (and, consequently, the latch or latches coupled thereto) by approximately sixty percent.

The main control link 18 carries an underslung shoe 104 and, thereabove on each side, a pair of extending and parallel stubs 106 and 108. The latter define receptive sockets for nesting therein the spheres 98, on each side of the link 18. Therefore, if force is applied to ends 100 of the bellcranks 90, the link 18 will be translated in the right-hand direction (as viewed in FIG. 6). So also, of course, if the shank 86 of the link 18 is pulled to the right, the bellcranks 90 will pivot (in opposite directions).

Chassis 23*a* has a pair of guideways 110 formed therein; the guideways 110 comprise generally rectangular voids on opposite sides of the housing 20*a*. Parallel sides of the guideways have upstanding ribs 112 in which are formed linear slots 114.

A night latch cam 116 is incorporated in the universal, center case sub-assembly 74, but it is operatively mounted below the bellcranks 90. Accordingly, for clarity of understanding, the housing 23*a* and part of the main control link 18 are omitted from FIG. 7, and only portions of the bellcranks 90 are shown in phantom, so that the night latch cam 116 can be seen to better advantage. The cam 116 comprises an annulus from which wings 118 extend on opposite sides. The cam 116 is engaged with a dowel 120; dowel 120 has a cylindrical shank 122 on which the cam 116 is journalled; the shank is also journalled in the chassis 23*a* in a borehole 124 provided therefor. Shank 122 has a groove 126 formed therein to receive a retaining ring 128; the latter secures the cam 116 on the shank 122.

The cam 116 has a tapped hole 130 formed therein offset from the center thereof; the hole 130 opens onto the outer wall of the shank 122. The hole 130 receives a drive screw 132 which has a leading, unthreaded portion 134. With the screw 132 threaded into the hole 130, an inner half of portion 134 is confined in the wall of the shank 122. The other, outer half of portion 134 engages an arcuate relief 136 provided therefor in the cam 116. Thus, screw 132 defines a sort of keying means to cause the dowel 120 and the cam 116 to rotate in common.

The cam 116 nestably engages the shoe 104 of the main control link 18 so that, with rotation of the cam 116 in either direction, one or other of the wings 118 will displace the shoe 104 to the alternative positioning thereof shown in broken line in FIG. 7. The screw 132, as can be seen in FIG. 8, has a slotted drive to accommodate a screwdriver. Now then, if a screwdriver is used to remove the screw 132, patently the subsequent rotation of the dowel 120 will have no effect on the cam 116. The dowel 120 will simply journal in the cam 116, and the latter will remain undisturbed, nested with the shoe 104. With the drive screw 132 removed from the dowel 120, however, the dowel is then freed to displace a tumbler engaged with the underside of the chassis 23*a*. This latter feature is more fully explained in the ensuring text.

The dowel 120 has a cruciform passage 138 formed fully therethrough. A key cylinder (not shown) having an extending, rotative, bladed element (or the like) can engage the passage 138 and rotate the dowel.

FIG. 9 shows the underside of the chassis 23*a* with the dowel 120 journalled in the borehole 124 and with the drive screw 132 fastened in place (i.e., "keying" the dowel 120 and cam 116 together). A tumbler, a trim lock tumbler 140, is slidably engaged, by fasteners 94, to the chassis and, in having slots 142, would slide except that the dowel 120 prevents this. The tumbler 140 has a tooth 144 which abuts the periphery of the dowel 120. Too, with the drive screw 132 in place, the dowel 120, due to restrictive movements of the link 18, bellcranks 90, etc., can only rotate about forty-five degrees of arc in each direction. It has a prominent, substantially semicircular cove 146 which can displace one of the lugs 148 astride the tooth 144, and drivingly receive the tooth, to slide the tumbler 140 to its alternative position. To effect this action, it is only necessary to remove the drive screw 132. As shown in FIG. 9, the lower guideway 110 is substantially blocked by the lowermost web portion of the tumbler 140, and the upper guideway 110 is substantially open therethrough. With the drive screw 132 removed, and the dowel turned counterclockwise, an alternative circumstance will obtain: the upper guideway will be substantially blocked by the uppermost web portion of the tumbler—the latter having travelled along the slots 142 to its upper disposition—and the lower guideway will be substantially open.

All the aforedescribed functionings of the night latch cam 116, dowel 120, drive screw 132, and trim lock tumbler 140 correspond to the functionings of the like, if not same, components as set out in U.S. Pat. No. 4,427,223, issued to M. Godec et al, on Jan. 24, 1984, for a "Latching Device". Accordingly, to supplement or clarify the descriptions given above, the cited patent and its specification are incorporated herein by reference.

The universal, center case sub-assembly 74 comprises all the elements depicted in FIGS. 6 through 9 and, by adding thereto, one may fabricate a rim-style center case assembly, or a vertical-style center case assembly, or a concealed-vertical-style center case assembly, or a combination rim and vertical style (surface or concealed).

The first of these, a rim-style center case assembly 150, built up from a basic sub-assembly 74, is shown in FIG. 10. Herein, the second ends 100 of the bellcranks 90 are pivotably coupled to thumbpiece lifts 152. The lifts 152 comprise limbs apertured at one end, to pivotably couple to the bellcranks 90, and having apertured parallel tabs 154 at the opposite end to receive pins 156 therethrough. The pins 156 are slidably captive in the slots 114.

Figure 2:
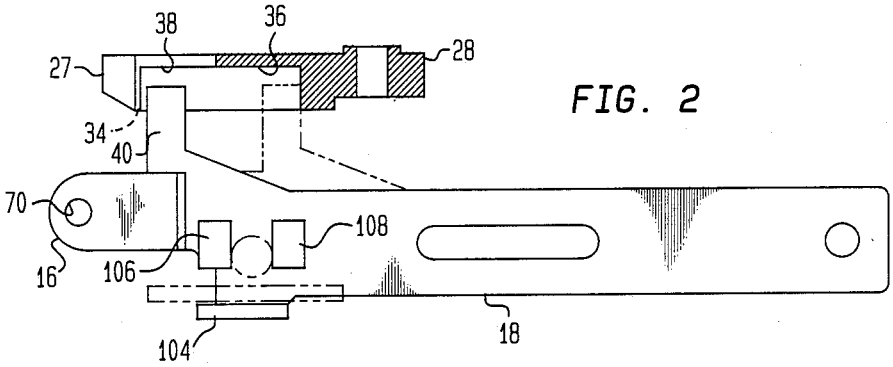
FIG. 2 is a side, elevational view of the main control link, according to the invention, in a preferred embodiment thereof, usable in the aforesaid latching assembly, and a gravity dog for use therewith, showing the cooperative relationship therebetween.

Corresponding to what is shown in FIGS. 1–3, and in line with the complementary descriptions thereof, assembly 150 has a latch 12 incorporated therewith and joined, by link 14, to the main control link 18. Descriptions of the biasing of the latch 12 by springs 60 (FIG. 3) and the cooperation of an auxiliary latch bolt 42 (FIGS. 1 and 3) with the latch 12 are not provided here; neither are such springs and auxiliary latch belt illustrated in connection with assembly 150 in FIG. 10. Those skilled in this art will appreciate, however, that assembly 150 incorporates such biasing and auxiliary latching. Optionally, too, assembly 150 may incorporate the gravity dog (28, FIGS. 1–3) feature of the prior art latching assembly 10.

A concealed-vertical-style center case assembly 158, also built up from a basic sub-assembly 74, is shown in FIG. 11. The second ends 100 of the bellcranks 90 are pivotably coupled to thumbpiece lifts which comprise attachment blocks 160. The nature and functioning blocks 160, in a concealed-vertical-assembly, are fully explained in co-pending U.S. patent application No. 627,722, filed on July 3, 1984, by Kun Hong Kim, for "An Operating Mechanism for a Closure Latching Assembly". Such, then, need not be described here. Suffice it to say that the attachment blocks 160 removably and adjustably receive ends of latch bolt-actuating, vertical rods (not shown) and, with translation of the blocks 160 through the guideways 110, the rods latch and unlatch upper and lower latchbolts (not shown).

A surface-vertical-style center case assembly 162 built up from the novel, universal, center case sub-assembly 74, is shown in FIG. 12. It is quite the same, in all respects, as assembly 158 (FIG. 11), except for the thumbpiece lifts. Assembly 158 employs the attachment blocks 160, whereas the assembly 162 has thumbpiece lifts 164 which have pairs of confronting L-shaped brackets 166. Brackets 166, as is well known from prior art surface-vertical-style center case assemblies, accept the vertical rods (not shown) which latch and unlatch upper and lower latchbolts.

As is fully understood in this art, ancillary, external, trim linkage (not shown) is operative of the thumbpiece lifts 152, 160 and/or 164. To facilitate such operation, or to frustrate such (and require a key/cylinder enablement), is the purpose of the trim lock tumbler 140 (FIG. 9), dowel 120, and drive screw 132. As shown in FIG. 9, the tumbler 140 will not accommodate trim linkage operation. The lower guideway 110, through which such linkage would need to translate, to displace a thumbpiece lift thereat, is quite effectively blocked by the tumbler. This is why, in such a circumstance, a key-and-lock cylinder must be used to operate the center case sub-assembly from outside of the associated portal.

Rim, concealed-vertical, and surface-vertical styles of center case assemblies have been described and illustrated, yet a further, novel, center case assembly may be constructed (a) pursuant to my invention, and (b) from the universal sub-assembly 74. This would be a three-point-latching center case assembly. It would comprise all the structure of a rim-style center case assembly 150 (FIG. 10), excepting for the type of thumbpiece lift. Instead of lifts 152, the three-point latching center case assembly would employ lifts 160 (FIG. 11) or 164 (FIG. 12). The latch 12, of course, would engage a strike on a mullion (not shown), and the lifts 160 or 164 would translate the well-known vertical, latch-bolt-actuating rods (not shown) for top and bottom latching as well.

While I have described my invention in connection with specific embodiments thereof, it is to be clearly understood that this is done only by way of example, and not as a limitation to the scope of my invention as set forth in the objects hereof, and in the appended claims.

I claim:

1. A universal, center case sub-assembly, for a panic-type exit device, comprising:

first means defining a chassis;

second means defining a center case housing coupled to said chassis;

a main control link;

said housing and link having means cooperating for guiding said link for slidable translation thereof within said housing between first and second dispositions; and a pair of bellcranks of generally V-shaped configuration, each thereof having a pair of limbs mutually diverging, to terminal limb ends, from a common, angular juncture; wherein each of said bellcranks has one of said terminal limb ends thereof pivotably mounted to one of said first and second means;

each of said bellcranks has the other of said terminal limb ends thereof engaged with said link (a) for pivotable movement thereof coincident with, and as a consequence of translation of said link, and (b) for translation of said link concident with, and as a consequence of, bellcrank pivotable movement;

said chassis has means on opposite sides of said housing defining guideways for movable thumbpiece lifts;

said common, angular junctures of said bellcranks each have means for coupling thereof to a thumbpiece lift, and each said juncture, with bellcrank pivotable movement, slues through an arc, of a given radius, toward and away from that one of said guideways which is most proximate thereto;

said control link has (a) means at one end for attachment thereof to a control link translating mechanism of a panic-type exit device, and (b) means at the opposite end thereof for coupling thereto a latchbolt link; and said housing has means for pinning a latchbolt, pivotably, thereto.

2. A universal, center case sub-ssembly, according to claim 1, wherein:

said other terminal limb end of each of said bellcranks has a sphere thereat;

said main control link has means defining a socket on each of opposite sides thereof;

and said spheres are engaged with said sockets.

3. A universal, center case sub-assembly, according to claim 1, wherein:

said other terminal limb end of each of said bellcranks, as a consequence of bellcrank pivotable movement, slues through an arc having a shorter radius than said given radius.

4. A universal, center case sub-assembly, according to claim 1, wherein:

said guideways comprise parallel ribs; and said ribs have channels formed therein.

* * * * *